United States Patent [19]

Kleinschmidt et al.

[11] 4,005,655

[45] Feb. 1, 1977

[54] INFLATABLE STABILIZER/RETARDER

[75] Inventors: Nick Kleinschmidt, China Lake; James V. Netzer, Ridgecrest, both of Calif.

[73] Assignee: The United States of America as represented by the Secretary of the Navy, Washington, D.C.

[22] Filed: Feb. 2, 1976

[21] Appl. No.: 654,315

[52] U.S. Cl. ..... 102/4; 244/3.27

[51] Int. Cl.[2] ..... F42B 25/02

[58] Field of Search ..... 102/2, 3, 4, 88, 35.6; 89/1.5 D; 244/3.24, 3.27, 3.28

[56] References Cited

UNITED STATES PATENTS

| | | | |
|---|---|---|---|
| 2,494,885 | 1/1950 | Lax et al. | 102/4 |
| 2,666,387 | 1/1954 | Richey | 102/2 |
| 2,693,327 | 11/1954 | Hild | 102/4 X |
| 3,114,315 | 12/1963 | Trump | 102/4 |
| 3,188,957 | 6/1965 | Petre | 244/3.27 |
| 3,713,387 | 1/1973 | Karp | 102/4 |
| 3,724,373 | 4/1973 | Rivenes | 244/3.27 X |
| 3,749,017 | 7/1973 | Peterson | 102/4 |
| 3,790,104 | 2/1974 | Jones | 244/3.28 X |

*Primary Examiner*—David H. Brown
*Attorney, Agent, or Firm*—R. S. Sciascia; Roy Miller; G. F. Baker

[57] ABSTRACT

An extensible aerodynamic stabilizer and retarder apparatus for use on the tail section of free fall weapons. The apparatus replaces the conventional tail fins previously used to stabilize such weapons. The disclosed apparatus is capable of collapsing to a diameter no larger than that of the diameter of the weapon itself. A weapon embodying the present invention can be usable in either of two retarding modes at the option of the aircraft pilot. The stabilizer and retarder comprises a plurality of pivotally attached fin members positioned symmetrically about the aft end of the bomb and connected together at their free ends by a strong flexible material. The attached fin members form a cylindrical area or chamber within which a flexible inflatable conical shaped bag is stored for deployment where a high drag mode of operation for the weapon is required.

11 Claims, 6 Drawing Figures

INFLATABLE STABILIZER/RETARDER

BACKGROUND OF THE INVENTION

1. Field of the Invention

This invention relates generally to stabilizer and retarder apparatus for free fall weapons for delaying the fall of the weapon to the target after its release from an attacking aircraft and resulting in a relatively low impact force when the weapon strikes the target.

2. Background of the Invention

A feature of the stabilizer and retarder apparatus is that it has utility on many types of free fall weapons and can be utilized without the requirement of extensive modification to existing weapons launching or carrying racks since the fin members conform to the same diameter as the body diameter when in their folded position. Utilization of relatively small fins connected by a flexible material results in a reduction in the size and weight of the weapon which, in turn, results in a stabilizer-retarder apparatus that is small in size and inexpensive to fabricate.

Demand in past years for more accurate bomb and missile delivery against ground targets from high speed aircraft has made it necessary that the delivering aircraft operate at low altitudes when attacking surface target. A major drawback with low level delivery is that the attacking aircraft must be flown at speeds and altitudes that place the aircraft in a position to be extremely vulnerable to surface weapons. An additional negative factor is that the aircraft may be damaged by the explosion and blast effects of the bombs which it has dropped. Further, the bombs may ricochet off the surface of the earth missing the target or, because of the high speed delivery, structural damage to the bomb may result which could affect its explosion characteristics.

Prior art attempts to overcome problems of high speed, low level aircraft bomb delivery have been many and varied. One approach was to attach a mechanism that would release a small drag type parachute to deploy after release of the bomb from the aircraft. These systems have had the inherent disadvantage of the necessity for relatively long parachute rises increasing the possibility that adjacent bomb chutes would become entangled with each other when there was a simultaneous release of more than one bomb. Another approach has been the use of metallic tail fins folded or hinged in various configurations to deploy whenever the bomb is released. These structures usually were collapsible and attached to the tail portion of the bomb or missile. Once released from the aircraft the force of the air flowing past the free falling weapon deployed the fins. Bombs of this structural arrangement have been inherently heavy, necessarily complex in structure and expensive to manufacture because of the complex mechanical structures necessary for reliable stabilizer fin deployment under all types of environmental conditions.

The present unique stabilizer/retarder apparatus for use with bombs or missiles overcomes the disadvantages of prior devices used to enable bomb delivery at high speed by providing a small, simple lightweight stabilizer retarder mechanism that is capable of either a high or low drag characteristic. The stabilizer retarder control apparatus allows the pilot to choose the drag desired at the time of weapon launching, thus permitting free fall of the weapon tailored to approach conditions and the type of target being attacked.

DESCRIPTION AND OPERATION

Figure 1:
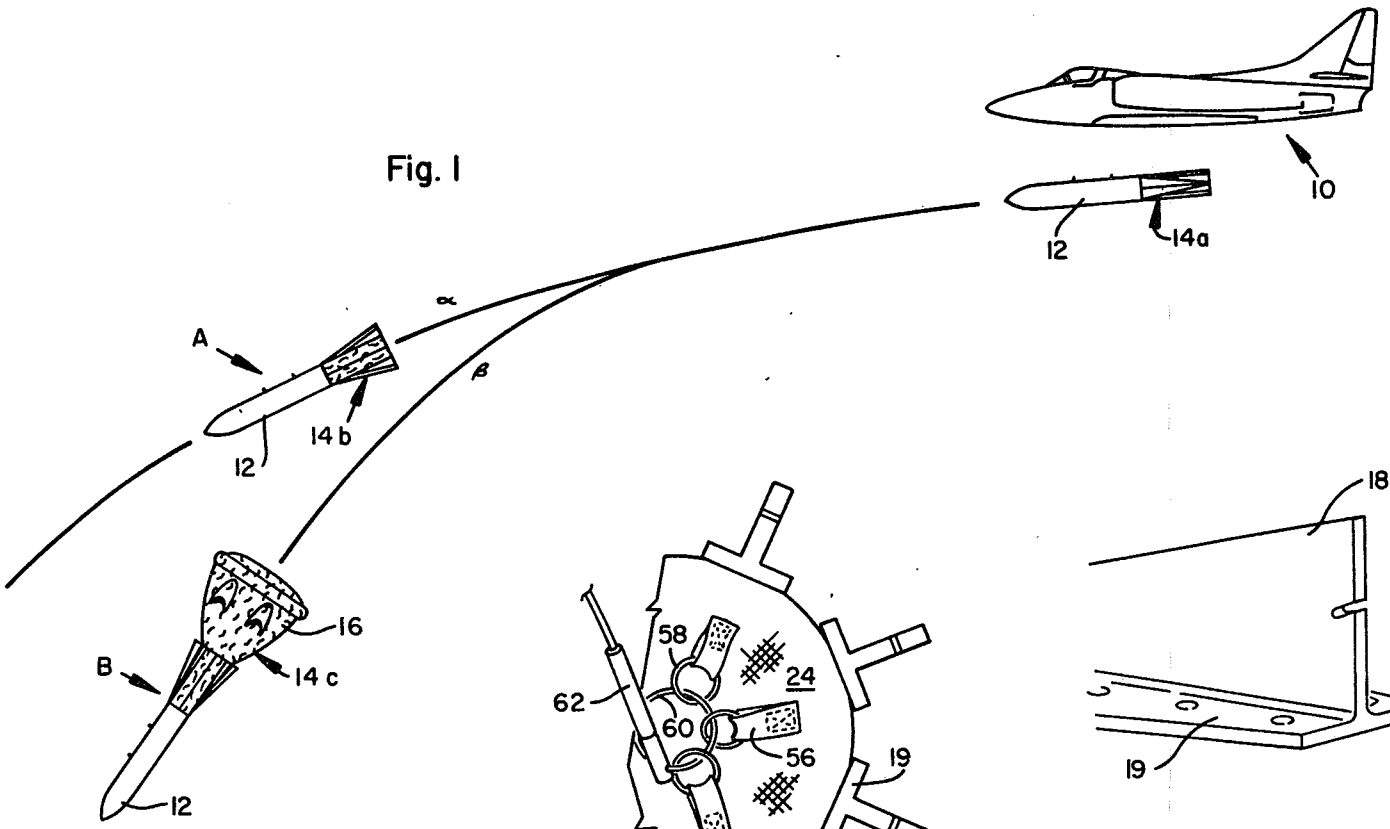
FIG. 1 is a pictorial view showing the general concept of the invention including the delivery aircraft and drop bomb.

Depicted in FIG. 1 of the drawing is an aircraft 10 delivering a drop bomb 12 with a tail section 14*a*. The diameter of the tail section 14*a* at delivery is substantially the same as the diameter of the main body of the bomb. By preselection of arming wire extraction modes the pilot can determine whether the bomb will thereafter assume a first low drag mode or a second high drag mode.

In the low drag mode shown at A, the tail section is only slightly extended beyond the diameter of the bomb 12. In this mode there is very little retardation but the fins (see 14*b*) are placed in a position to furnish greater stabilization for the flight of the bomb.

In the fully retarded mode, indicated at B, the retarding mechanism is fully deployed as shown at 14*c*. In this mode a balloon type structure 16 is deployed to produce a relatively high drag on the weapon.

In the low drag mode the weapon follows a path $\alpha$ which is practically ballistic. In the high drag mode, however, the weapon follows a path $\beta$ which is much more to be desired in low level delivery of drop bombs.

Figure 2:
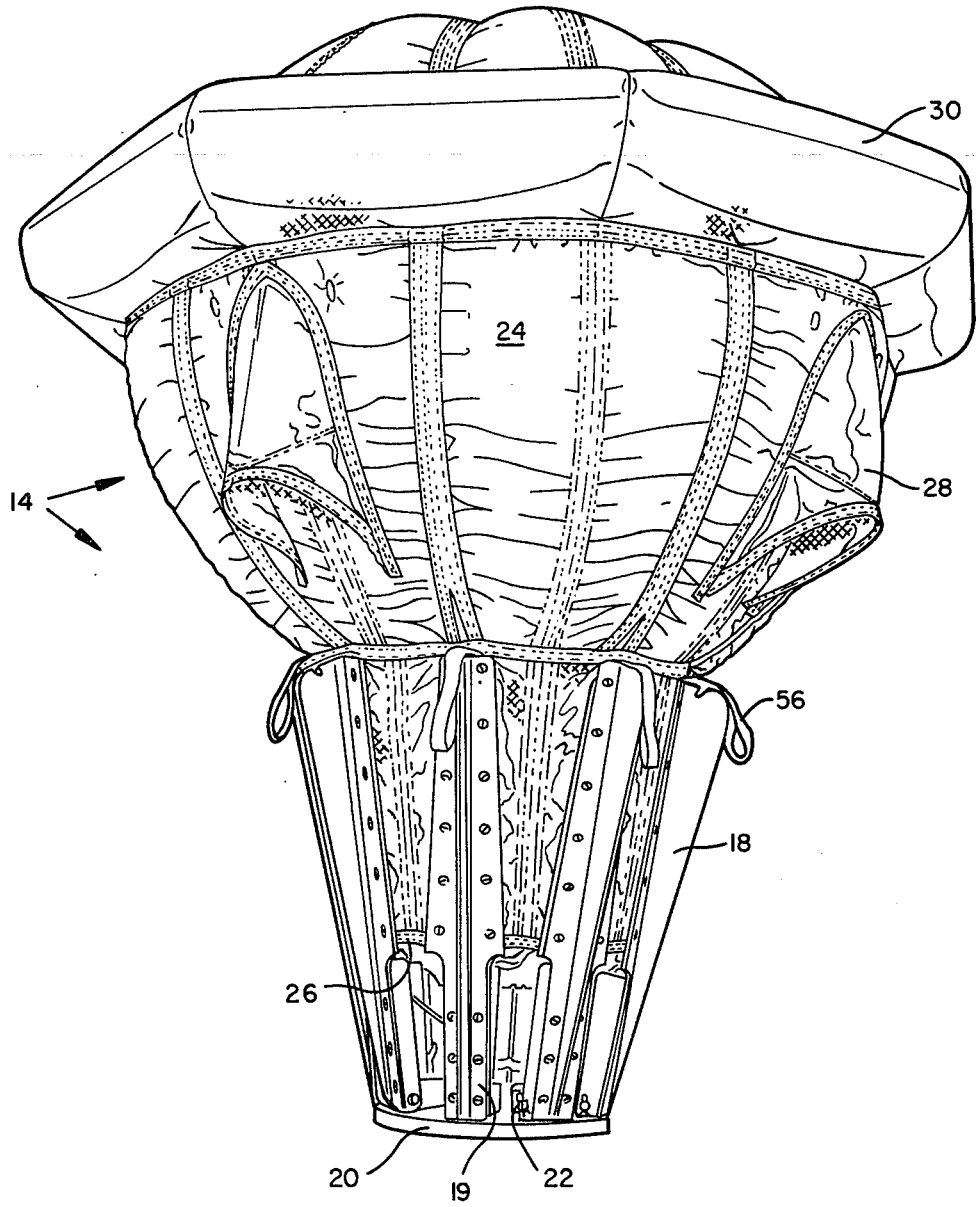
FIG. 2 is an isometric view of a retarder according to the present invention in fully extended form.

As shown in FIG. 2, the stabilizing and retarding mechanism 14 comprises a number (8 in this configuration) of small thin fin elements 18 formed integrally with a base or web member 19 to constitute a structure of T shaped cross section pivotally fastened to a rear terminal bulkhead or mounting ring 20 by means of pins 22. The base or web portions orthogonal to the fin members are attached to spaced portions of a fabric bag 24 form roughly a cylindrical chamber within which the fabric bag may be fully contained in the delivery mode.

The fabric bag 24 is designed to be inflated by ram air after the bomb is launched. For this purpose there are two sets of openings for air to enter the interior of the bag. The first of these openings is indicated at 26 in FIG. 2, each being placed in the open space between two of the fin members. In the low drag made, the bag only receives air through these openings or ports.

For use in the high drag mode larger air scoops 28 are provided around the intermediate portion of bag 24. To further increase drag in the high drag mode, the bag 24 is provided with a circumferential protrusion 30 which provides added turbulance to enhance the retardation.

Figure 4:
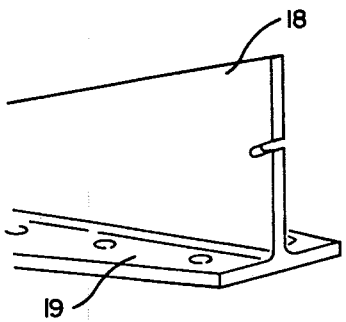
FIG. 4 is a detailed view of the aft end of a fin.
Figure 5:
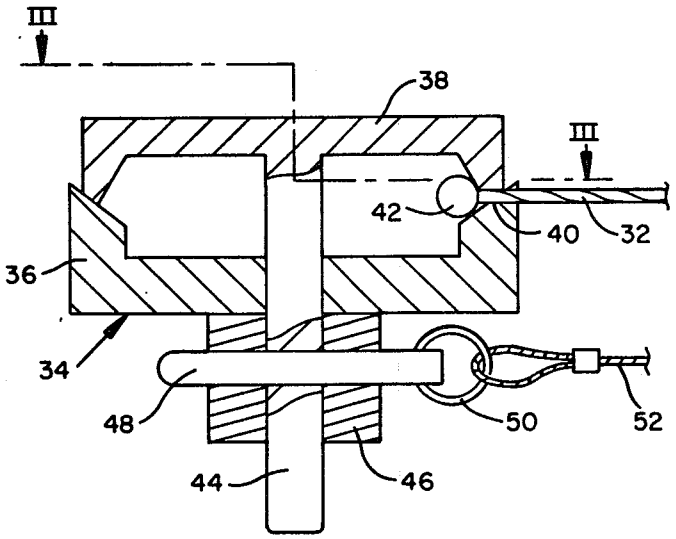
FIG. 5 is a enlarged detail view taken along line V—V of FIG. 3.
Figure 3:
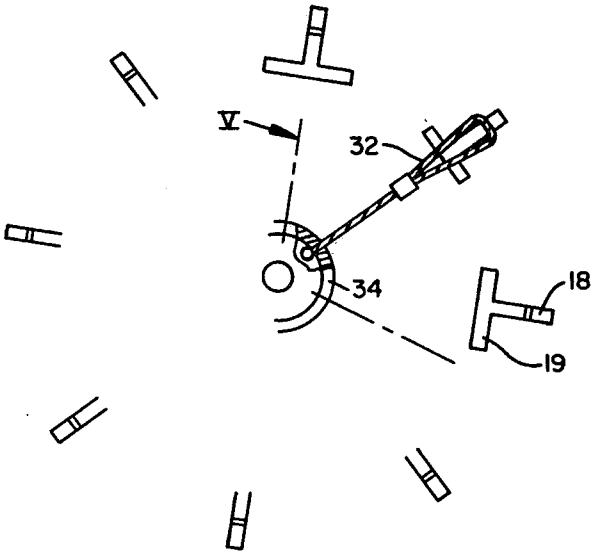
FIG. 3 is a rear view of a weapon according to the present invention in its delivery form.

In the delivery mode all of the fins are confined to approximately the diameter of the bomb by individual lanyards 32 which are fastened into slots (see FIG. 4) in the ends of the fin members and confined within an adapter or locking device 34. (See FIG. 5) The locking device 34, as shown in FIG. 5, comprises a cup shaped retaining member 36 and a clamp member 38 which have complementary mating surfaces interrupted by a number of slots 40, 41 designed to confine the lanyards 32. The lanyards 32 may be confined within the slots in the mating surfaces between the members 36, 38 by reason of a ball 42 fastened to the end of each lanyard 32.

The members 36, 38 are maintained together in locked position by means of a stem 44 fastened to member 38 and passing through member 36. A lock ring 46 is placed on element 44 and a pin is placed through elements 46 and 44 to fasten the assembly together. Pin 48 is provided with a ring 50 which may be attached to the arming wire 52 which is designed to pull the pin 48 when the bomb is deployed from an aircraft.

Figure 6:
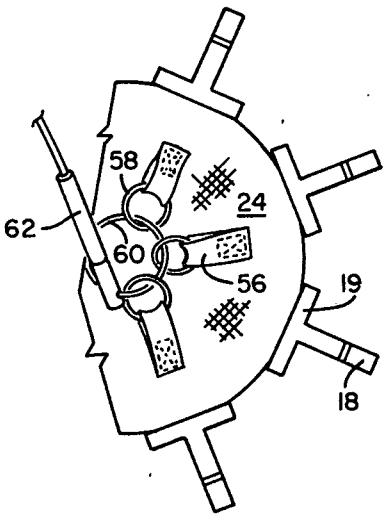
FIG. 6 is an end view of the weapon according to the invention in the low drag retarder mode.

When pin 48 is pulled, the members 36, 38 separate and the lanyards 32 are freed to move outwardly allowing the fins to pivot around their pins 22 and ram air entering ports 26 will cause the fins to fan out into the stabilizer position shown at A in FIG. 1. FIG. 6 is a partial view looking at the rear of the device as deployed to this extent. The bag 24 is shown with a number of bands 56 which serve to hold rings 58 fastened thereto. The rings 58 are fastened together by a cable 60 which also runs through a conventional cable cutter 62 and the ends of cable 60 are fastened together in a conventional manner to retain the bag 24 in the position shown. In this position, the fins 18 are deployed sufficiently to stabilize the flight of the bomb but provide only a small amount of drag. In actual practice, there are two cable cutters 62 for redundancy in the interest of reliability.

When it is desired to have full deployment of the retarder device, a second arming wire (not shown) is extracted from the assembly to allow actuation of the cable cutter 62. If desired, there may be a timer means included so that the cable cutters are only actuated after the expiration of a predetermined time delay.

When the cable cutter 62 is operated, the cable 60 is parted and the bag 24 is free to inflate fully. Inflation is started by continued ram air force through ports 26 and, as soon as the scoops 28 clear the fin area, more air is scooped in to aid in fully extending the bag. As the weapon continues to fall, ram air maintains the bag in its fully extended position whereby sufficient drag forces are created to retard the speed of the bomb and cause it to follow a path shorter than the normal ballistics path.

What is claimed is:

1. A tail assembly for a fin stabilized retarded bomb comprising:
- an adapter ring configured to permit attachment to the aft end of a bomb;
- a plurality of fin members each having one end pivotally attached to said adapter ring;
- said fin members comprising a structural member of T-shaped cross section with the fin portion attached to a base cross member or web portion extending orthogonal to said fin portion;
- said fin members forming together a cylindrical enclosure area;
- an inflatable bag positioned within said cylindrical enclosure area and being fastened to said web portions;
- said inflatable bag having first and second ram air openings designed to admit air to the inside of said bag when the bomb is released from an aircraft;
- means for confining said fin members at the aft end thereof so that the fin portions of said members are substantially confined within the envelope diameter of the bomb;
- means for confining said bag from opening further than a predetermined amount;
- means for removing the restraint of said confining means and allowing full inflation of said bag.

2. In a retardable drop bomb or the like adapted to be released from a delivery aircraft the combination comprising:
- a rear terminal bulkhead;
- a tailsection attached to said bulkhead and comprising fin means deployable from a first mode, wherein said section presents a contour wholly within the envelope diameter of said bomb, selectively to a second mode wherein said section presents a stabilizing substantially conical contour and selectively to yet a third mode, wherein said section presents a greater conical contour effective to retard the velocity of the bomb after it's release from the aircraft;
- said fin means comprising a plurality of fin members each having one end pivotally attached to said bulkhead:
- said fin members extending rearwardly of said bulkhead and having base portions lying within a surface of revolution; loosely defining a chamber therewithin;
- an inflatable fabric bag within said chamber;
- and including means for causing inflation of said bag with ram air when said bomb is deployed in said second or third mode.

3. The apparatus of claim 2 wherein said base portions include means fastening said base portions to spaced portions of said bag; and said means for causing inflation including openings in said bag between said spaced portions thereof.

4. The apparatus of claim 3 wherein said tail section includes:
- first means for confining said fin means to the contour of said first mode;
- second means for confining said fin means in said second mode; and
- selectively operable means actuable to render said confining means inoperable in a planned manner.

5. The apparatus of claim 4 wherein said fin members pivot by reason of partial inflation of said bag from said first mode position to said second mode position when said first confining means is rendered inoperable and the bomb is falling through the atmosphere.

6. The apparatus of claim 5 wherein said bag fully inflates and presents a larger conical contour extending from said fin members when said second confining means is rendered inoperative.

7. The apparatus of claim 5 wherein said bag includes a peripheral generally torroidal protuberance in the area of greatest circumference.

8. The apparatus of claim 3 wherein said bag includes a peripheral generally torroidal protuberance in the area of greatest circumference.

9. The apparatus of claim 8 wherein said tail section includes:
- first means for confining said fin means to the contour of said first mode;

second means for confining said fin means in said second mode; and selectively operable means actuable to render said confining means inoperable in a planned manner.

10. The apparatus of claim 9 wherein said fin members pivot by reason of partial inflation of said bag from said first mode position to said second mode position when said first confining means is rendered inoperable and the bomb is falling through the atmosphere.

11. The apparatus of claim 10 wherein said fin members pivot by reason of partial inflation of said bag from said first mode position to said second mode position when said first confining means is rendered inoperable and the bomb is falling through the atmosphere.

* * * * *